US009454125B1

(12) United States Patent
Bejat et al.

(10) Patent No.: US 9,454,125 B1
(45) Date of Patent: Sep. 27, 2016

(54) SYSTEMS AND METHODS FOR REINCORPORATING WASTE TONER WITH FRESH TONER WITHIN A TONER CARTRIDGE

(71) Applicant: LEXMARK INTERNATIONAL, INC., Lexington, KY (US)

(72) Inventors: Ligia Aura Bejat, Lexington, KY (US); Michael Alan Gist, Lexington, KY (US); Michael Craig Leemhuis, Nicholasville, KY (US); Prabuddha Jyotindra Mehta, Lexington, KY (US); Eric Carl Stelter, Lexington, KY (US); David Anthony Schneider, Lexington, KY (US); Kelly Marie Wright, Sadieville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/975,994

(22) Filed: Dec. 21, 2015

(51) Int. Cl.
*G03G 15/08* (2006.01)
*G03G 21/10* (2006.01)
*G03G 21/12* (2006.01)

(52) U.S. Cl.
CPC ..... *G03G 21/10* (2013.01); *G03G 15/0832* (2013.01); *G03G 15/0834* (2013.01); *G03G 15/0836* (2013.01); *G03G 15/0837* (2013.01); *G03G 21/105* (2013.01); *G03G 21/12* (2013.01)

(58) Field of Classification Search
CPC .... G03G 21/10; G03G 21/12; G03G 21/105; G03G 15/0836; G03G 15/0832; G03G 15/0837; G03G 15/0834
USPC ..... 399/120
See application file for complete search history.

(56) References Cited

U.S. PATENT DOCUMENTS 4,660,960 A * 4/1987 Fukunaga ..... G03G 21/105 222/DIG. 1
5,084,734 A 1/1992 Yoshino et al.
5,781,841 A 7/1998 Kouroku et al.
(Continued)

FOREIGN PATENT DOCUMENTS

JP 03075768 A * 3/1991

OTHER PUBLICATIONS

U.S. Appl. No. 14/975,972 (Bejat et al.), filed Dec. 21, 2015.
(Continued)

*Primary Examiner* — David Gray
*Assistant Examiner* — Tyler Hardman
(74) *Attorney, Agent, or Firm* — Justin M. Tromp

(57) ABSTRACT

A toner cartridge according to one example includes a housing having a toner reservoir, an exit for exiting toner and an entry port for receiving waste toner. A partition divides the reservoir into a first compartment for storing fresh toner and a second compartment for storing waste toner. The first compartment is in fluid communication with the exit. The partition is movable within the reservoir between a first position and a second position. The entry port is in fluid communication with the first compartment when the partition is in the first position such that waste toner received through the entry port is deposited into the first compartment. The entry port is in fluid communication with the second compartment but closed off from the first compartment when the partition is in the second position such that waste toner received through the entry port is deposited into the second compartment.

15 Claims, 11 Drawing Sheets

(56) References Cited

U.S. PATENT DOCUMENTS

| | | | | |
|---|---|---|---|---|
| 5,842,093 | A | 11/1998 | Tanda | |
| 6,339,689 | B1 * | 1/2002 | Sugiura | G03G 21/12 399/120 |
| 6,567,631 | B2 * | 5/2003 | Funayama | G03G 21/12 399/120 |
| 7,962,063 | B2 | 6/2011 | d'Entrecasteaux | |
| 8,761,638 | B2 * | 6/2014 | Wang | G03G 15/0865 399/120 |
| 8,918,031 | B2 | 12/2014 | Abler et al. | |
| 8,918,032 | B2 | 12/2014 | Abler et al. | |
| 8,923,734 | B2 | 12/2014 | Abler et al. | |
| 9,063,460 | B2 | 6/2015 | Abler et al. | |
| 2009/0232548 | A1 * | 9/2009 | d'Entrecasteaux | G03G 21/12 399/120 |
| 2009/0245863 | A1 * | 10/2009 | Sato | G03G 15/0844 399/120 |
| 2012/0177406 | A1 * | 7/2012 | Suzuki | G03G 15/0874 399/120 |
| 2014/0079438 | A1 * | 3/2014 | Abler | G03G 15/0875 399/262 |
| 2014/0079441 | A1 * | 3/2014 | Abler | G03G 15/0875 399/262 |

OTHER PUBLICATIONS

U.S. Appl. No. 14/975,986 (Bejat et al.), filed Dec. 21, 2015.
U.S. Appl. No. 14/976,001 (Bejat et al.), filed Dec. 21, 2015.

* cited by examiner

SYSTEMS AND METHODS FOR REINCORPORATING WASTE TONER WITH FRESH TONER WITHIN A TONER CARTRIDGE

CROSS REFERENCES TO RELATED APPLICATIONS

None.

BACKGROUND

1. Field of the Disclosure

The present disclosure relates generally to electrophotographic imaging devices such as printers or multifunction devices having printing capability, and more particularly to systems and methods for reincorporating waste toner with fresh toner within a toner cartridge.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the photoconductive drum. The toned image is transferred to the print media (e.g., paper) either directly by the photoconductive drum in a one-step transfer system or indirectly by an intermediate transfer member in a two-step transfer system. The toner is then fused to the media using heat and pressure to complete the print.

However, not all of the toner picked up by the photoconductive drum is transferred to the print media or intermediate transfer member due to inefficiencies in the image transfer process. Residual toner left on the photoconductive drum after the photoconductive drum has contacted the print media or intermediate transfer member must be removed before the next image is formed in order to avoid contamination of the next image. For this purpose, a cleaner blade or a cleaner brush is placed in contact with the photoconductive drum (and, in a two-step transfer system, the intermediate transfer member) to wipe the residual toner from its surface. The residual toner removed by the cleaner blade or cleaner brush is then stored in a waste toner container. The size of the waste toner container is preferably minimized in order to reduce the overall size of the image forming device.

The image forming device's toner supply is typically stored in one or more toner cartridges that must be replaced periodically to continue to provide toner to the image forming device for printing. In order to ensure optimized performance, it is desirable to communicate conditions of the toner cartridge to the image forming device for proper operation.

SUMMARY

A toner cartridge for an electrophotographic image forming device according to one example embodiment includes a housing having a reservoir for storing toner. The housing has an exit for exiting toner from the housing and an entry port for receiving waste toner into the housing. A partition divides the reservoir into a first compartment for storing fresh toner and a second compartment for storing waste toner. The first compartment is in fluid communication with the exit. The partition is movable within the reservoir between a first position and a second position. The entry port is in fluid communication with the first compartment when the partition is in the first position such that waste toner received through the entry port is deposited into the first compartment when the partition is in the first position and the entry port is in fluid communication with the second compartment but closed off from the first compartment when the partition is in the second position such that waste toner received through the entry port is deposited into the second compartment but blocked from entering the first compartment when the partition is in the second position.

A system for recycling waste toner in an electrophotographic image forming device according to one example embodiment includes a toner cartridge including a housing having a reservoir for storing toner and a partition within the reservoir dividing the reservoir into a first compartment for storing fresh toner and a second compartment for storing waste toner. The housing has an exit in fluid communication with the first compartment for exiting toner from the toner cartridge and at least one waste toner entry point for introducing waste toner into the toner cartridge. A waste toner transfer system is positioned to move waste toner in the electrophotographic image forming device to the at least one waste toner entry point of the toner cartridge. The waste toner transfer system is configured to deliver an initial amount of waste toner from the electrophotographic image forming device into the first compartment of the toner cartridge for mixing with the fresh toner and a remaining amount of waste toner from the electrophotographic image forming device into the second compartment of the toner cartridge separated from the first compartment.

A method for recycling waste toner into a toner cartridge of an electrophotographic image forming device according to one example embodiment includes partitioning a reservoir of the toner cartridge into a first compartment for storing fresh toner and a second compartment for storing waste toner. An initial amount of waste toner in the electrophotographic image forming device is moved into the first compartment of the toner cartridge reservoir for mixing with the fresh toner. After the initial amount of waste toner is moved into the first compartment, a remaining amount of waste toner in the electrophotographic image forming device is moved into the second compartment of the toner cartridge reservoir separated from the fresh toner in the first compartment.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION in the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
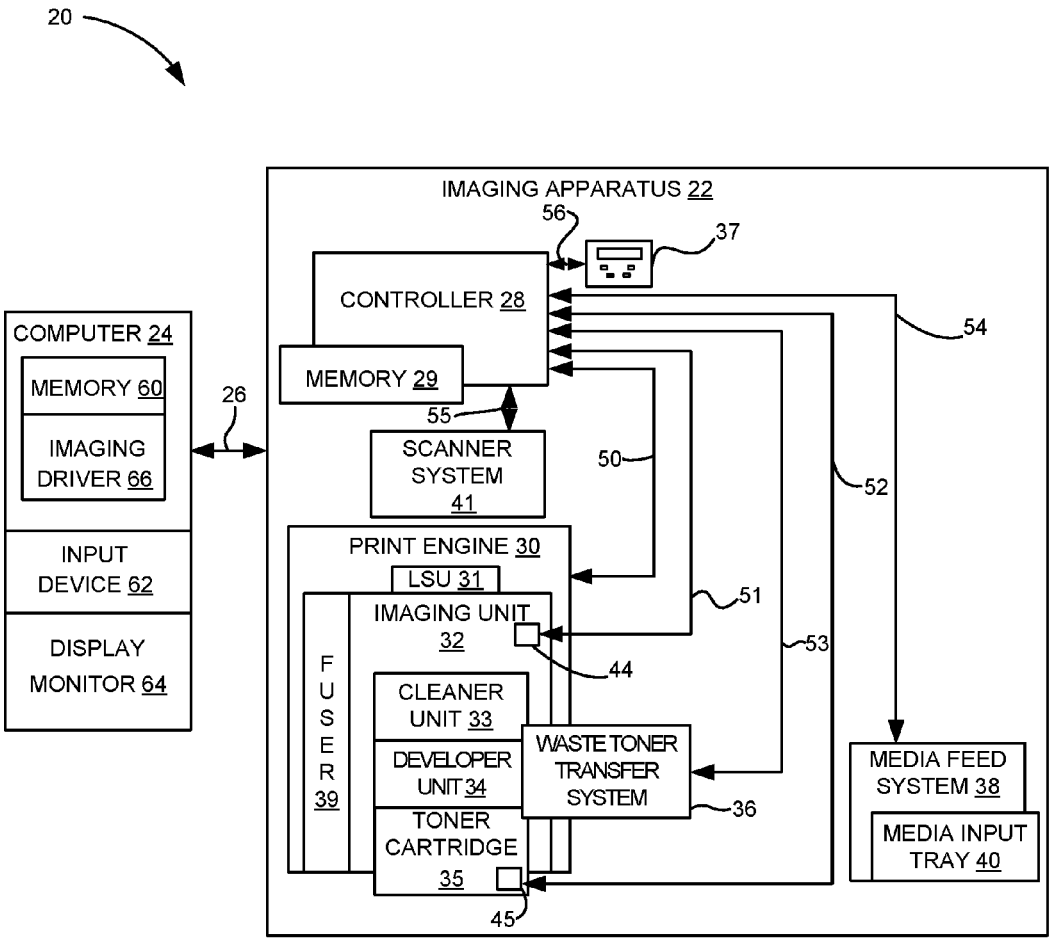
FIG. 1 is a block diagram depiction of an imaging system according to one example embodiment.

Referring now to the drawings and particularly to FIG. 1, there is shown a diagrammatic depiction of an imaging system 20 according to one example embodiment. As shown, imaging system 20 may include an imaging apparatus 22 and a computer 24. Imaging apparatus 22 communicates with computer 24 via a communications link 26. As used herein, the term "communications link" is used to generally refer to any structure that facilitates electronic communication between multiple components, and may operate using wired or wireless technology and may include communications over the Internet.

In the embodiment shown in FIG. 1, imaging apparatus 22 is shown as a multifunction machine that includes a controller 28, a print engine 30, a laser scan unit (LSU) 31, an imaging unit 32, a toner cartridge 35, a waste toner transfer system 36, a user interface 37, a media feed system 38, a media input tray 40 and a scanner system 41. Imaging apparatus 22 may communicate with computer 24 via a standard communication protocol, such as, for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 41 or a standalone printer.

Controller 28 includes a processor unit and associated memory 29 and may be formed as one or more Application Specific Integrated Circuits (ASICs). Memory 29 may be any volatile or non-volatile memory or combinations thereof such as, for example, random access memory (RAM), read only memory (ROM), flash memory, and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with waste toner transfer system 36 via communications link 53. Controller 28 communicates with media feed system 38 via a communications link 54. Controller 28 communicates with scanner system 41 via a communications link 55. User interface 37 is communicatively coupled to controller 28 via a communications link 56. Processing circuits 44, 45 may provide authentication functions, safety and operational interlocks, operating parameters and usage information related to imaging unit 32 and toner cartridge 35, respectively. Each of processing circuitry 44, 45 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45. Controller 28 serves to process print data and to operate print engine 30 during printing, as well as to operate scanner system 41 and process data obtained via scanner system 41.

Computer 24, which is optional, may be, for example, a personal computer, network server, tablet computer, smartphone or other hand-held electronic device, including memory 60, such as volatile and/or non-volatile memory, an input device 62, such as a keyboard, and a display, such as a monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 includes laser scan unit 31, toner cartridge 35, imaging unit 32, and a fuser 39, all mounted within imaging apparatus 22. The imaging unit 32 is removably mounted in imaging apparatus 22 and includes a developer unit 34 that houses a toner sump and a toner development system. In one embodiment, the toner development system utilizes what is commonly referred to as a single component development system. In this embodiment, the toner development system includes a toner adder roll that provides toner from the toner sump to a developer roll. A doctor blade provides a metered uniform layer of toner on the surface of the developer roll. In another embodiment, the toner development system utilizes what is commonly referred to as a dual component development system. In this embodiment, toner in the toner sump of developer unit 34 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 34 includes a magnetic roll that attracts the magnetic carrier beads having toner thereon to the magnetic roll through the use of magnetic fields. Imaging unit 32 also includes a cleaner unit 33 that houses a photoconductive drum and a waste toner removal system.

In one embodiment, the cleaner unit 33 and developer unit 34 are assembled together and installed onto a frame of the imaging unit 32. The toner cartridge 35 is then installed on or in proximity with the frame in a mating relation with the developer unit 34. Laser scan unit 31 creates a latent image on the photoconductive drum in the cleaner unit 33. Toner is transferred from the toner sump in developer unit 34 to the latent image on the photoconductive drum by the developer roll (in the case of a single component development system) or by the magnetic roll (in the case of a dual component development system) to create a toned image. The toned image is subsequently transferred to a media sheet from media input tray 40 for printing. Toner may be transferred directly to the media sheet by the photoconductive drum in a one-step transfer system or by an intermediate transfer member that receives the toner from the photoconductive drum in a two-step transfer system. The toner image is bonded to the media sheet in the fuser 39 and then sent to an output location or to one or more finishing options such as a duplexer, a stapler or hole punch. Toner remnants are removed from the photoconductive drum (and, in the case of a two-step transfer system, the intermediate transfer member) by the waste toner removal system and are transported back into the toner cartridge 35 by the waste toner transfer system 36 as discussed in greater detail below.

Controller 28 oversees the functioning of the imaging apparatus 22 including, imaging unit 32, LSU 31, waste toner transfer system 36, user interface 37 and the movement of the media along media path(s) within imaging apparatus 22. Toner cartridge 35 and/or imaging unit 32 may also contain its own associated memory as discussed above.

Figure 2:
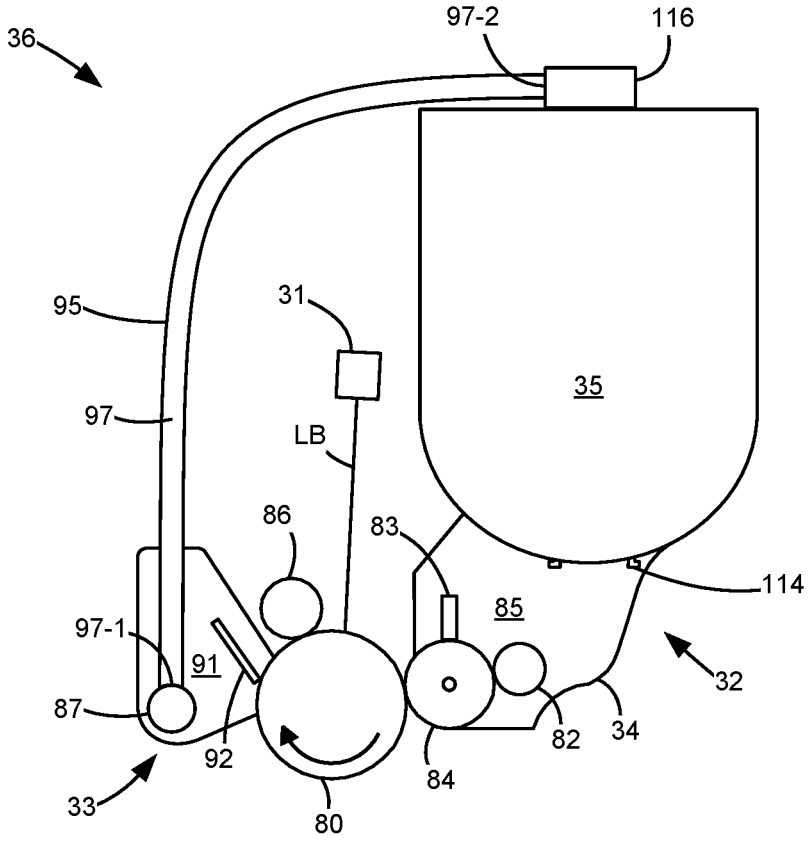
FIG. 2 is a schematic diagram of a toner cartridge, an imaging unit and a waste toner transfer system according to one example embodiment.

FIG. 2 illustrates a schematic illustration of imaging unit 32 and toner cartridge 35 with waste toner transfer system 36 according to one example embodiment. In the example embodiment illustrated, developer unit 34 utilizes a single component development system. In this embodiment, developer unit 34 includes a toner adder roll 82, a doctor blade 83, a developer roll 84 and a toner sump 85. An exit port 114 on the toner cartridge 35 communicates, either directly or through an intermediate channel, with an inlet port on the developer unit 34 allowing toner to be periodically transferred from the toner cartridge 35 to resupply the toner sump 85 in the developer unit 34. The toner adder roll 82 coats the developer roll 84 with toner while electrostatically charging the toner particles. As the toner is placed on the developer roll 84, the doctor blade 83 evens the toner to a predetermined thickness. A charging roll 86 forms a nip with photoconductive drum 80 and charges the surface of photoconductive drum 80 to a specified voltage. A laser beam LB from laser scan unit 31 is directed to the surface of photoconductive drum 80 and discharges those areas it contacts to form a latent image. The developer roll 84, which also forms a nip with photoconductive drum 80, then transfers toner to photoconductive drum 80 to form a toner image. The toner is attracted to the areas of the surface of photoconductive drum 80 discharged by the laser beam. The cleaner unit 33 then removes any remaining particles of toner from photoconductive drum 80 after the toner image is transferred to either the media or an intermediate transfer mechanism. Cleaner unit 33 includes a storage volume 91 for collecting waste toner. A cleaner roll or blade 92 abuts photoconductive drum 80 (and, in the case of a two-step transfer system, the intermediate transfer member) to remove waste toner from the surface thereof. Waste toner removed by cleaner blade 92 collects within the storage volume 91.

In one example embodiment, waste toner transfer system 36 includes a waste toner transport mechanism 95 disposed between cleaner unit 33 and toner cartridge 35 for transporting waste toner collected within storage volume 91 back into toner cartridge 35. In the example shown, waste toner transport mechanism 95 includes a waste tube 97 having a first end 97-1 in fluid communication with storage volume 91 via a waste toner outlet 87 of cleaner unit 33 and a second end 97-2 which fluidly communicates with a waste toner inlet port 116 of toner cartridge 35. In one example embodiment, waste tube 97 defines an auger path between the cleaner unit 33 and toner cartridge 35. For example, a spiral screw-like auger or auger wire may be provided along the length of waste tube 97 and driven by a motor (not shown) to transport waste toner from waste toner storage volume 91 to toner cartridge 35.

Figure 3:
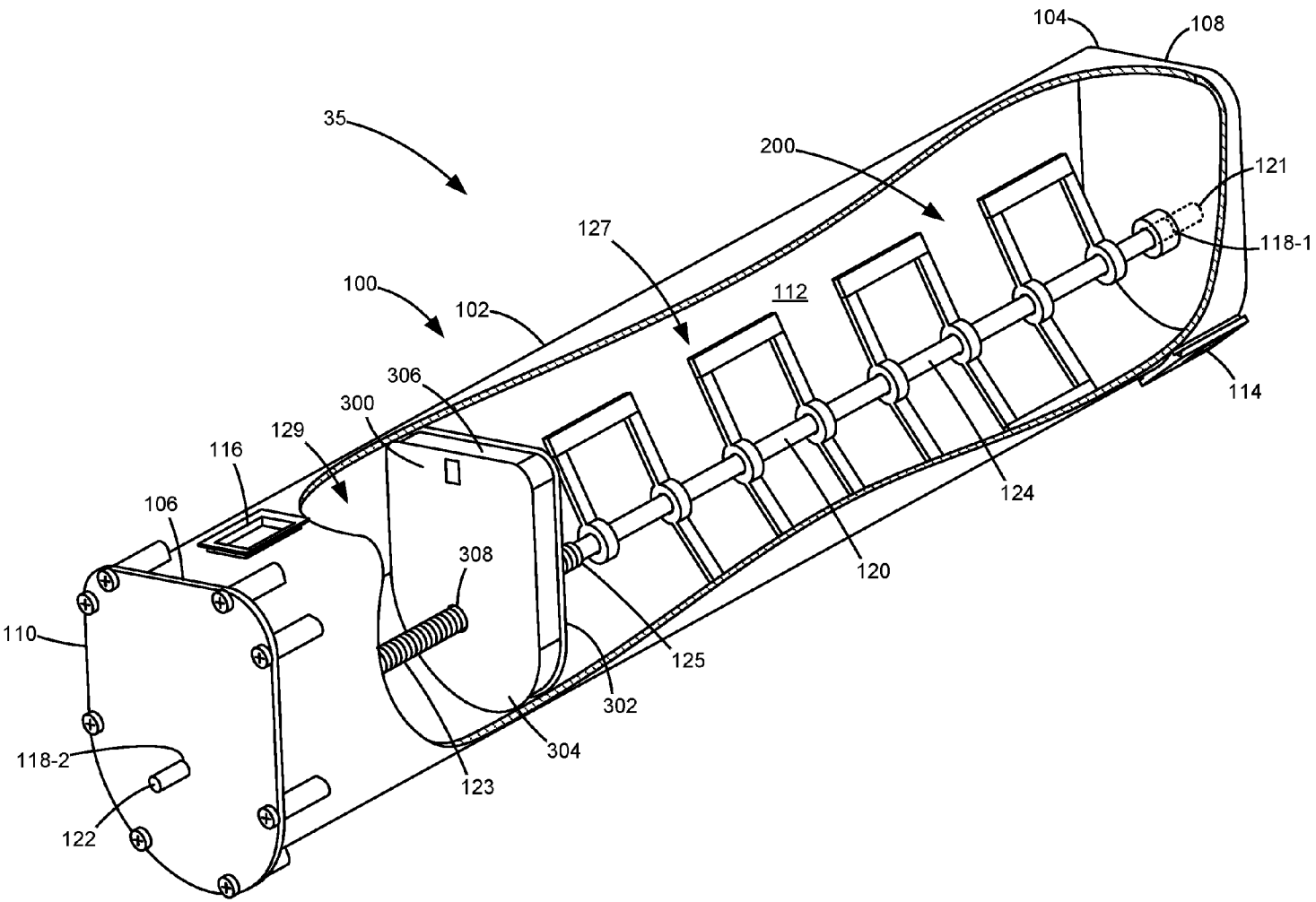
FIG. 3 is a perspective view of a toner cartridge illustrating interior components thereof including a partition dividing the toner cartridge into a fresh toner compartment and a waste toner compartment according to one example embodiment.

Referring now to FIG. 3, toner cartridge 35 is shown according to one example embodiment. Toner cartridge 35 includes a housing 100 having a body 102 with first and second ends 104, 106. Body 102 may be termed "tubular" or "elongate" and may have various shapes other than that shown in the example illustration. Enclosing each of ends 104, 106 are first and second end walls 108, 110, respectively forming a toner reservoir 112 for containing toner. Exit port 114 is shown positioned on a lower portion of body 102 near one of the ends, end 104 as illustrated. Exit port 114 is in fluid communication with toner reservoir 112 to allow toner to be delivered from the toner reservoir 112 to the toner sump 85 of developer unit 34. Waste toner inlet port 116 is shown provided on an upper portion of body 102 near end wall 110 opposite exit port 114. Waste toner inlet port 116 is also in fluid communication with toner reservoir 112 to allow waste toner to be delivered by waste toner transfer system 36 from the cleaner unit 33 to toner cartridge 35 and into toner reservoir 112. A shutter (not shown) may be provided on each of exit port 114 and waste toner inlet port 116 that is biased closed to provide added sealing of the exit port 114 and waste toner inlet port 116 when toner cartridge 35 is not installed in imaging apparatus 22.

Aligned openings 118-1, 118-2 are provided in end walls 108, 110. A drive shaft 120 is positioned within toner reservoir 112 and extends along the length of the body 102 with first and second ends 121, 122 thereof extending into aligned openings 118-1, 118-2 in end walls 108, 110. A drive coupler (not shown) is operatively connected to drive shaft 120 and exposed on the exterior of housing 100 such that when toner cartridge 35 is inserted into imaging apparatus 22, the drive coupler engages with a drive mechanism (not shown) in imaging apparatus 22 that provides rotational force to the drive coupler and, in turn, drive shaft 120. The size and configuration of the drive coupler is a matter of design choice and may include a gear or gear train or a coupler such as an Oldham coupler as is known in the art. The drive mechanism in imaging apparatus 22 may be provided with an encoder (not shown) that allows controller 28 to monitor the amount of rotation, angular position and speed of drive shaft 120.

Drive shaft 120 has a threaded portion 123 and an unthreaded portion 124 that meet at a junction 125. In one example embodiment, the diameter of unthreaded portion 124 is less than or equal to a root diameter of the threaded portion 123. In one example embodiment, unthreaded portion 124 has a length that is greater than a length of threaded portion 123. In general, the length of threaded portion 123 may depend upon how much waste toner is to be collected within toner cartridge 35, and/or may correspond to a portion of the longitudinal volume of toner reservoir 112 for storing waste toner. In one example, threaded portion 123 has a length that is approximately one-third of the length of drive shaft 120 within reservoir 112. A paddle assembly 200 is coupled to the drive shaft 120 along the unthreaded portion 124 and rotates with drive shaft 120 to move toner towards exit port 114. Toner cartridge 35 periodically performs a toner addition cycle wherein controller 28 rotates drive shaft 120 a predetermined amount in order to rotate paddle assembly 200 to deliver toner from toner cartridge 35 to toner sump 85 of developer unit 34 when the amount of toner in the toner sump 85 falls below a threshold. Mounted on the threaded portion 123 of drive shaft 120 is a partition 300 that divides the toner reservoir 112 into a first toner compartment 127 for storing fresh toner and a second toner compartment 129 for storing waste toner. First toner compartment 127 is in fluid communication with exit port 114 to allow fresh toner to be supplied to developer unit 34. Depending on the axial location of partition 300 along threaded portion 123, waste toner inlet port 116 may fluidly communicate with the first toner compartment 127 or second toner compartment 129. In FIG. 3, partition 300 is positioned such that waste toner inlet port 116 is in fluid communication with second toner compartment 129.

Partition 300 includes a front surface 302, a rear surface 304 and an edge surface 306 interconnecting the front and rear surfaces 302, 304. Based on design choice, partition 300 may be a solid or hollow structure. The front surface 302 and rear surface 304 of partition 300 may be generally smooth and planar and may be generally orthogonal to the axis of rotation of drive shaft 120. One of skill in the art will recognize that other shapes, including non-planar, angled or curvilinear shapes, may be used for the front surface 302 and rear surface 304 and that the shapes of the front surface 302 and rear surface 304 can be different from each other. The edge surface 306 or outer perimeter of partition 300 is shaped to closely conform to the cross-sectional shape of toner reservoir 112 in body 102 while still being able to travel within toner reservoir 112 in order to minimize toner leakage around partition 300.

In accordance with example embodiments of the present disclosure, partition 300 is configured to travel along the threaded portion 123 of the drive shaft 120 when the drive shaft 120 rotates. Axial movement of partition 300 changes the volume of at least one of the first and second toner compartments 127, 129. For example, in the embodiment illustrated, when drive shaft 120 rotates in an operative rotational direction, partition 300 moves axially toward junction 125 and away from end 106 decreasing the volume of the first toner compartment 127 and increasing the volume of the second toner compartment 129. Axial movement of partition 300 towards junction 125 may also aid in pushing toner within the first toner compartment 127 toward the exit port 114. Conversely, when drive shaft 120 rotates in a reverse direction opposite the operative rotational direction, partition 300 moves axially away from junction 125 and toward end 106 increasing the volume of the first toner compartment 127 and decreasing the volume of the second toner compartment 129.

Drive shaft 120 passes through an opening 308 in partition 300. In order to allow partition 300 to move axially along the threaded portion 123 of drive shaft 120, in the example embodiment illustrated, opening 308 has a threaded inner circumferential surface forming a threaded hole 308 that matably couples to the threaded portion 123 of drive shaft 120. In this manner, partition 300 operates as a thread follower moving along the threaded portion 123 as drive shaft 120 rotates. A drive shaft seal (not shown) may be provided in or on front surface 302 and/or rear surface 304 to prevent toner leaking through opening 308 of partition 300. In general, the threaded portion 123 and threaded hole 308 have a thread pitch that allows partition 300 to move along drive shaft 120 at a speed that does not cause the volume of the second toner compartment 129 to increase at a rate faster than a rate at which fresh toner is removed from the first toner compartment 127. In one example, the thread pitch is selected such that a predetermined number of revolutions of drive shaft 120 during each toner addition cycle causes partition 300 to translate a predetermined distance along drive shaft 120.

Figure 4A:
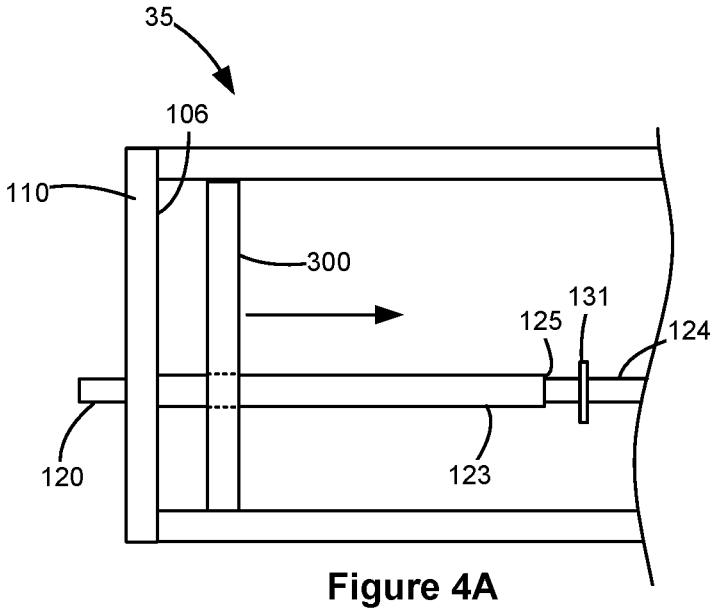
FIGS. 4A and 4B illustrate the partition within the toner cartridge positioned at different axial positions along a shaft.
Figure 4B:
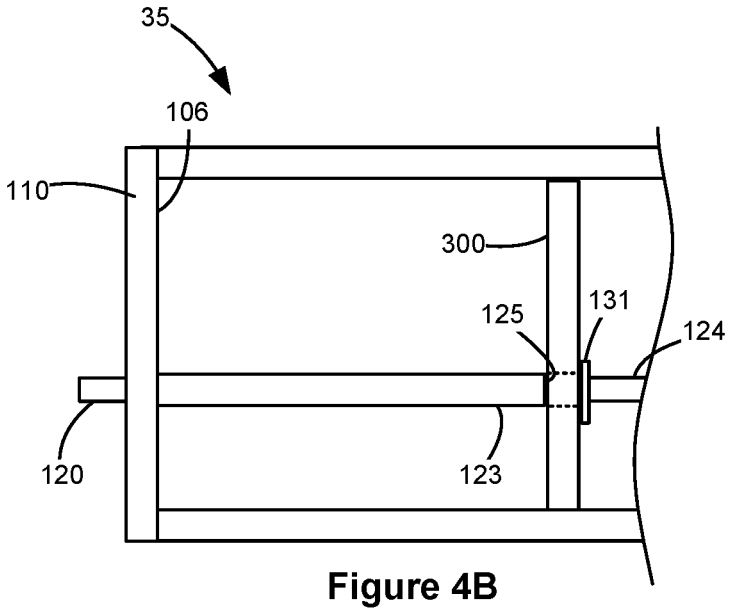

With reference to FIGS. 4A and 4B, when drive shaft 120 rotates and partition 300 is positioned on the threaded portion 123 as shown in FIG. 4A, partition 300 moves axially along drive shaft 120 due to the coupling between threaded hole 308 and threaded portion 123. In contrast, when drive shaft 120 rotates and partition 300 is positioned on the unthreaded portion 124 as shown in FIG. 4B, partition 300 does not move axially along drive shaft 120. That is, after partition 300 moves axially past junction 125 due to rotation of drive shaft 120 in its operative rotational direction and partition couples to the unthreaded portion 124, partition 300 stops moving axially toward exit port 114 even if drive shaft 120 continues rotating. A stop member 131, which may be in the form of a ring, may be positioned along the unthreaded portion 124 to block partition 300 from moving further toward exit port 114. In another example embodiment, past the location where partition 300 moves from threaded portion 123 onto unthreaded portion 124, the diameter of unthreaded portion 124 increases to greater than the diameter of opening 308 on partition 300 in order to block partition 300 from moving further toward exit port 114.

The configurations for moving partition 300 along drive shaft 120 of toner cartridge 35 and stopping partition 300 at a predetermined stop position are not limited to the example embodiments illustrated and other configurations may be implemented. For example, in one alternative embodiment, partition 300 may move along the threaded portion 123 of drive shaft 120 until partition 300 hits a stop and the threaded central portion of partition 300 is mechanically disconnected from the partition 300, such as by breaking the area surrounding the threaded hole 308 from partition 300. In another alternative embodiment, a coupling member, such as a threaded nut, may be mounted in or on partition 300 about opening 308 to movably couple partition 300 to drive shaft 120 and allow partition 300 to move axially when drive shaft 120 rotates. In another alternative embodiment, a spring loaded nut may be used that is mounted on partition 300 and held onto the threaded portion 123 by a spring, and when partition 300 moves to the end of the threaded portion 123 of drive shaft 120, the nut is pushed toward the center of the drive shaft 120 onto the unthreaded portion 124 of the drive shaft 120. Other examples are disclosed in U.S. Pat. No. 9,063,460 entitled "Volumetric Toner Cartridge Having Driven Toner Platform" filed on Sep. 14, 2012 and assigned to the assignee of the present application, the content of which is incorporated herein by reference in its entirety. In still other alternative example embodiments, partition 300 may move within toner cartridge 35 along drive shaft 120 of toner cartridge 35 using other techniques in lieu of or in addition to using a threaded configuration between drive shaft 120 and partition 300.

In one example embodiment, partition 300 is sealed to prevent toner leakage between the first toner compartment 127 and second toner compartment 129. In one example, a passive bag or bellows (not shown) may be provided within the second toner compartment 129, with one end of the bag attached to partition 300 and the other end of the bag attached to second end 106 such that the bag expands as partition 300 moves toward junction 125 and/or as waste toner enters the second toner compartment 129. In another example, a fur seal, woven seal, foam seal, or microfiber fabric may be provided on the edge surface 306 of partition 300 adjacent to the inner surface of body 102 to provide sealing between the first and second toner compartments 127, 129.

Figure 5:
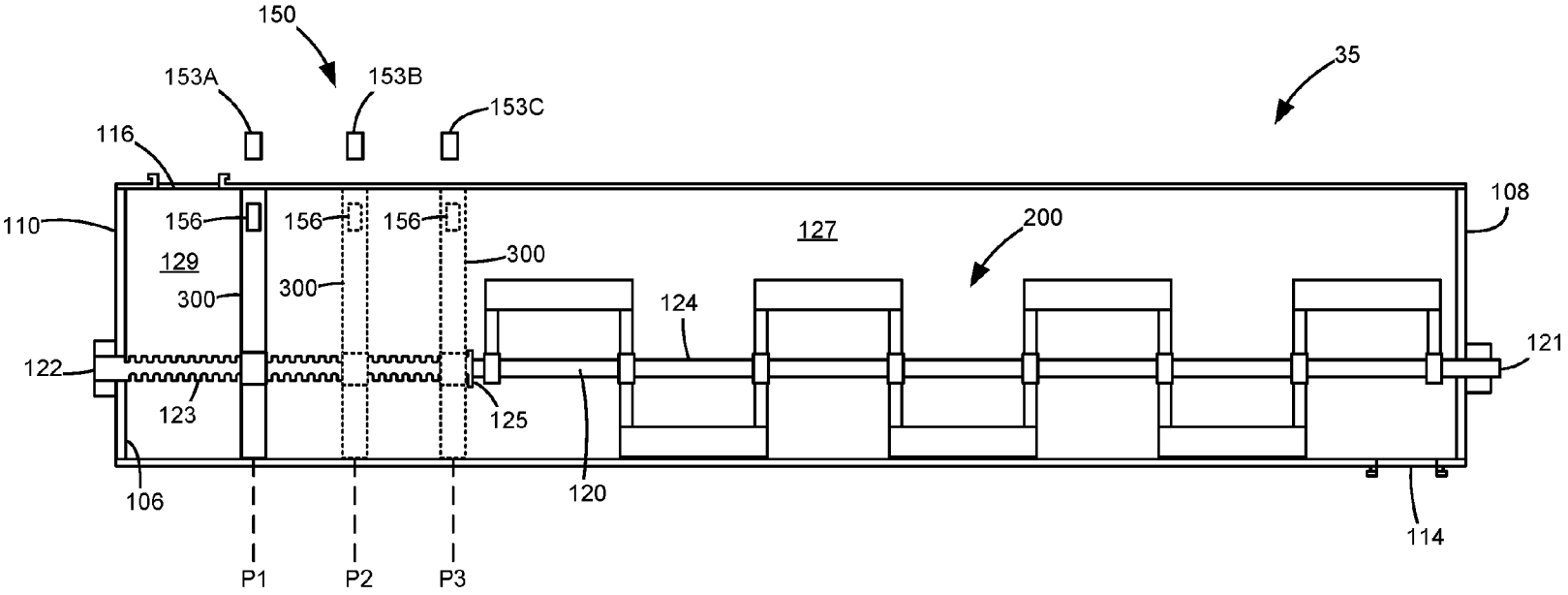
FIG. 5 illustrates a sensing arrangement for sensing an axial position of the partition within the toner cartridge according to one example embodiment.

With reference to FIG. 5, a sensing arrangement 150 is provided for monitoring an axial position of partition 300 along drive shaft 120. Sensing arrangement 150 includes a plurality of sensors 153 (shown as sensors 153A, 153B and 153C in FIG. 5) arranged at predetermined axial locations relative to drive shaft 120 and at least one sensed member 156 connected to partition 300. The plurality of sensors 153 are communicatively coupled to controller 28 and are positioned to detect an axial position of the sensed member 156 relative to the drive shaft 120 when the toner cartridge 35 is installed in the imaging apparatus 22. In turn, controller 28 determines an axial position of the partition 300 along the drive shaft 120 based on signals received from at least one of the plurality of sensors 153.

In one example embodiment, the plurality of sensors 153 include magnetic sensors and the sensed member 156 may be or include a permanent magnet detectable by the magnetic sensors 153. Magnetic sensors 153 may be Hall Effect sensors for detecting magnetic field strength(s) from magnetic field lines extending between toner cartridge 35 and magnetic sensors 153, but it is understood that the sensors 153 may be other types of sensors that are capable of sensing the presence or absence of a magnetic field. Using sensors 153, controller 28 samples or otherwise collects measurements of the magnetic field generated by magnet 156 on partition 300 and processes the collected measurements, which includes determining an axial position of partition 300 along the drive shaft 120.

Partition 300 is movable between an initial position and a final position along drive shaft 120. As used herein, the initial position of partition 300 corresponds to a position of partition 300 prior to the first use of toner cartridge 35 and the final position corresponds to a position at which partition 300 stops and no longer moves along drive shaft 120 when drive shaft 120 rotates after toner cartridge 35 has been used. In the example embodiment illustrated in FIG. 5, the initial position P1 of partition 300 is past the location of waste toner inlet port 116, relative to a direction of travel by partition 300 towards junction 125, such that waste toner inlet port 116 is initially in fluid communication with the second toner compartment 129. The first toner compartment 127 is initially filled with fresh toner (not shown) and the second toner compartment 129 is initially empty and reserved for storing waste toner. In this example configuration, waste toner delivered by the waste toner transport mechanism 95 is deposited within the second toner compartment 129 at the outset of toner cartridge use.

In one example embodiment, magnetic sensors 153 are positioned within imaging apparatus 22 proximate an exterior of housing 100 of toner cartridge 35 at predetermined axial locations to monitor the axial movement and/or axial position of partition 300 when toner cartridge 35 is installed in imaging apparatus 22. Magnet 156 may be positioned in any one of a plurality of positions on the front surface 302, rear surface 304 or edge surface 306 of partition 300, and each magnetic sensor 153 is positioned so that magnet 156 passes proximally and/or adjacent thereto when partition 300 travels axially along drive shaft 120. In other example embodiments, each magnetic sensor 153 is positioned within or as part of toner cartridge 35. In this example, each sensor 153 may communicate measurement readings to controller 28 via a communication interface between imaging apparatus 22 and toner cartridge 35, such as processing circuitry 45 associated with toner cartridge 35.

Moving partition 300 along the drive shaft 120 results in the magnet 156 being located closer or farther away from a corresponding sensor(s) 153, thereby varying the magnetic field strength detected by each sensor 153 and allowing controller 28 to determine the location of partition 300 along drive shaft 120. In the example shown, sensor 153A is positioned to detect partition 300 when partition 300 is at the initial position P1, sensor 153B is positioned to detect when partition 300 is at an intermediate position P2 between the initial position P1 and final position P3 and sensor 153C is positioned to detect when partition 300 reaches the final position P3. Each sensor 153 may be monitored for the presence or absence of a magnetic field to determine the axial location of partition 300. For example, when the movable partition 300 is at the initial position P1, sensor 153A may detect the presence of a magnetic field and the remaining sensors 153B, 153C may indicate the absence of a magnetic field, indicating the partition 300 is at the initial position P1. Likewise, sensor 153B may detect the presence of a magnetic field and the remaining sensors 153A, 153C may indicate the absence of a magnetic field when partition 300 is at the intermediate position P2 and sensor 153C may detect the presence of a magnetic field and the remaining sensors 153A, 153B may indicate the absence of a magnetic field when partition is at the final position P3.

In another embodiment, detection by sensors 153 of the presence of the magnetic field generated by magnet 156 may overlap. For example, when partition 300 is at the initial position P1, sensor 153A may detect the presence of a magnetic field and the remaining sensors 153B, 153C may indicate the absence of a magnetic field, indicating the partition 300 is at the initial position P1. When partition 300 moves to a position between positions P1 and P2, sensors 153A and 153B may detect the presence of the magnetic field and sensor 153C may indicate the absence of a magnetic field, indicating that partition 300 is located between positions P1 and P2. When partition 300 is at the position P2, sensor 153B may detect the presence of a magnetic field and the remaining sensors 153A, 153C may indicate the absence of a magnetic field, indicating the partition 300 is at the position P2. When partition 300 moves to a position between positions P2 and P3, sensors 153B and 153C may detect the presence of the magnetic field and sensor 153A may indicate the absence of a magnetic field, indicating that partition 300 is located between positions P2 and P3. Finally, when partition 300 is at the final position P3, sensor 153C may detect the presence of a magnetic field and the remaining sensors 153A, 153B may indicate the absence of a magnetic field, indicating the partition 300 is at the final position P3. In other alternative embodiments, controller 28 may interpolate and/or extrapolate measured data received from sensor(s) 153 to determine the axial position of partition 300 on drive shaft 120. Although not shown, it is understood that any suitable number of sensors 153 may be positioned between sensors 153A and 153C for sensing intermediate positions of partition 300 between the initial and final positions P1, P3.

In one example embodiment, imaging apparatus 22 uses information relating to the axial movement and/or position of partition 300 along drive shaft 120 to determine a state or condition relating to toner cartridge 35. For example, controller 28 may determine whether toner cartridge 35 is operating normally, such as whether drive shaft 120 and paddle assembly 200 are functioning properly, based on the movement and/or axial position of partition 300. During magnetic field measurement, sensor(s) 153 detect the magnetic field from magnet 156 and the amount of rotation of drive shaft 120 is monitored using the encoder of the drive mechanism driving drive shaft 120. Since the thread pitch of threaded portion 123 is known, an expected amount of axial displacement by partition 300 along drive shaft 120 may be calculated based on the number of rotations of drive shaft 120. Controller 28 may compare the sensed axial position of partition 300, which is based on readings from sensor(s) 153, with the expected axial position of partition 300 as determined based on the number of rotations of drive shaft 120. If the sensed axial position corresponds to the expected axial position, an indication may be made that toner cartridge 35 is operating normally, as expected. A mismatch between the sensed axial position and the expected axial position, however, may indicate that toner cartridge 35 is not operating normally. For example, if a sensor(s) 153 is not triggered at an appropriate time at which magnet 156 is expected to trigger a corresponding sensor 153, an indication may be determined that a faulty toner cartridge 35 has been installed or that toner replenishment is not functioning properly. If it is detected that toner cartridge 35 is not operating normally, controller 28 may control imaging apparatus 22 to respond in a number of ways. In one example, controller 28 may control imaging apparatus 22 to provide an error feedback via user interface 37. In another example embodiment, the presence of movable partition 300 and/or axial movement thereof may be used to determine whether toner cartridge 35 is compatible with imaging apparatus 22. Controller 28 may determine that toner cartridge 35 is compatible for use with imaging apparatus 22 upon detection by one or more of sensors 153, such as at one or more predetermined axial locations relative to drive shaft 120.

Figure 6:
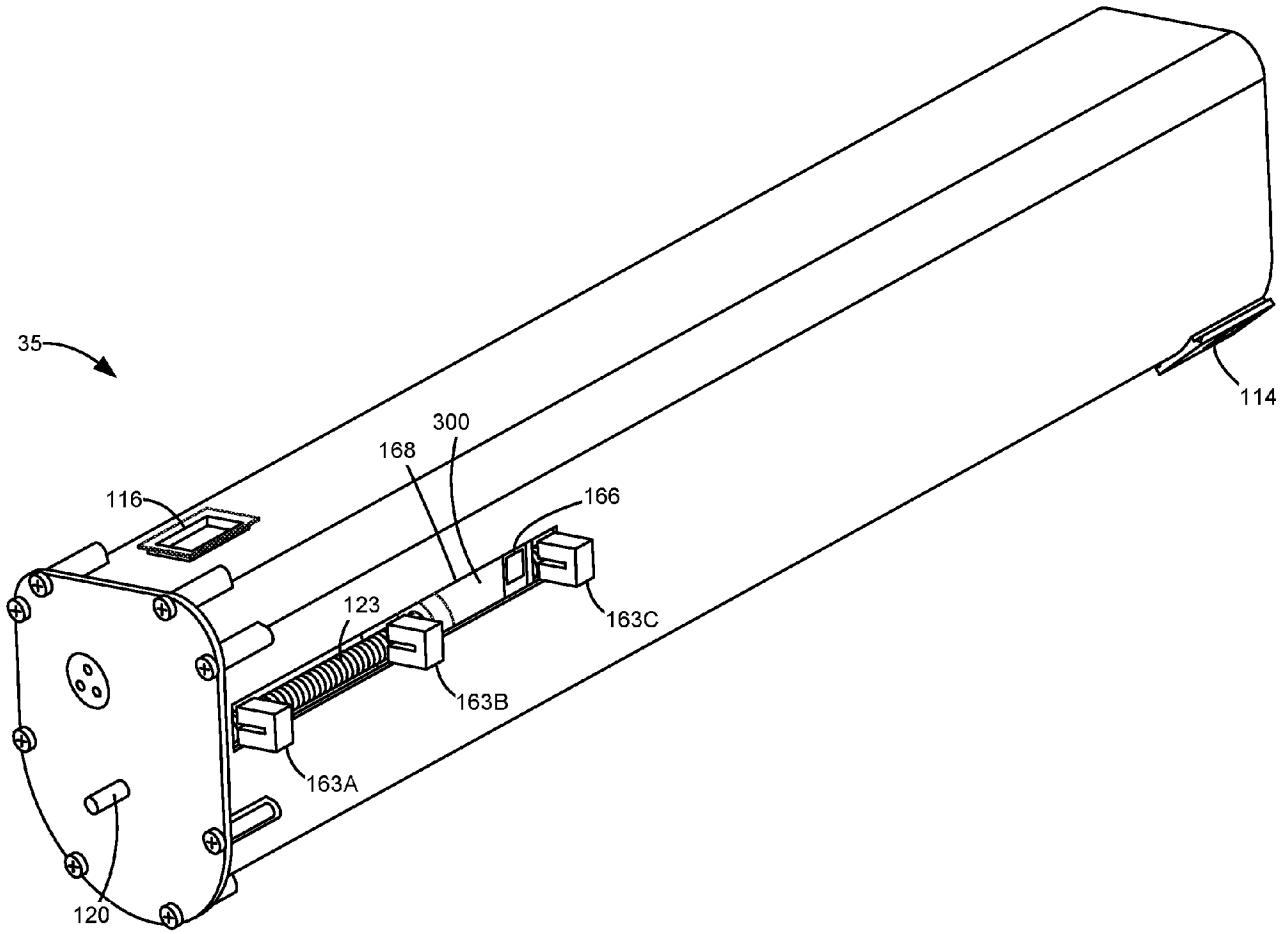
FIG. 6 is a perspective view of a toner cartridge and a sensing arrangement utilizing optical components to monitor an axial position of the partition within the toner cartridge according to one example embodiment.

In an alternative example embodiment, sensing arrangement 150 may utilize optical components to monitor the axial movement of partition 300 along drive shaft 120. For example, with reference to FIG. 6, sensing arrangement 150 includes optical sensors 163 (shown as optical sensors 163A, 163B and 163C in FIG. 6) positioned on an exterior of housing 100 and arranged at predetermined axial locations relative to drive shaft 120, and a reflective member 166 disposed on partition 300. Reflective member 166 can be constructed using different combinations of materials to exhibit substantial reflectivity to light in the ultraviolet, visible, or infrared regions of the electromagnetic spectrum, and is readable by each optical sensor 163. Each optical sensor 163 may include an emitter which emits optical energy to reflective member 166 and a corresponding detector that receives an amount of optical energy reflected by the reflective member 166. In this example embodiment, toner cartridge 35 includes a substantially transparent or transmissive window 168 to allow optical energy to travel between optical sensor 163 and reflective member 166. The window 168 may span at least a length corresponding to the range of travel of partition 300 between its initial position P1 and final position P3. In operation, each optical sensor 163 detects partition 300 if it is positioned such that reflective member 166 is located along the optical path of a corresponding optical sensor 163 to receive and reflect optical energy thereto. Optical sensor 163A is positioned to detect partition 300 when it is at the initial position P1, optical sensor 163B is positioned to detect when partition 300 is at intermediate position P2 and optical sensor 163C is positioned to detect when partition 300 reaches its final position P3. Controller 28 determines an axial position of the partition 300 along the drive shaft 120 based on signals received from at least one of the plurality of optical sensors 163.

In other alternative example embodiments, sensing arrangement 150 may utilize other sensing mechanisms to monitor the axial movement of partition 300 along drive shaft 120. In one example, the inner surface of body 102 of toner cartridge 35 may include electrical contacts or switches (not shown) arranged at predetermined axial locations relative to drive shaft 120 that are engaged and triggered by partition 300 as partition 300 travels along drive shaft 120. In this example, each electrical contact or switch may be communicatively coupled to the processing circuitry 45 associated with toner cartridge 35 and processing circuitry 45 may communicate output signals of each switch to controller 28 of imaging apparatus 22 to indicate that partition 300 is at an axial position corresponding to an axial location of the switch that was triggered. In another example, toner cartridge 35 may include tab sensors (not shown) that are broken off or pushed out of the side of toner cartridge 35 when engaged by partition 300 as partition 300 travels along drive shaft 120. Further, in other embodiments, sensing arrangement 150 may be used to monitor the position of a passive partition, such as, for example, a bag positioned in reservoir 112 that receives waste toner entering waste toner inlet port 116 and expands within reservoir 112 as the bag fills with toner. For example, the bag may include at least one permanent magnet and magnetic sensors may be positioned to detect whether the bag is in an initial contracted or folded state, one or more partially expanded states or a fully expanded state.

Figure 7:
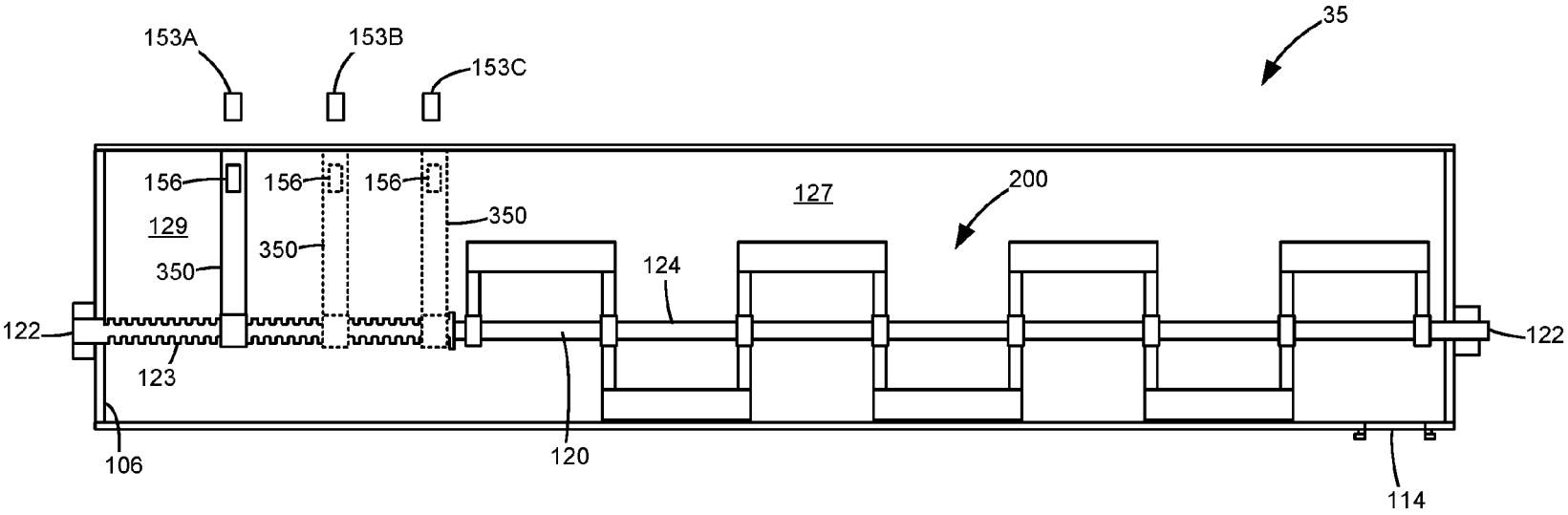
FIG. 7 illustrates a toner cartridge including an arm axially movable along the shaft according to one example embodiment.

The concept of determining a state or condition of toner cartridge 35 based on axial movement of a member mounted on drive shaft 120 may be applied to other toner cartridges with or without a partition therein. For example, FIG. 7 illustrates an embodiment of toner cartridge 35 having a thread follower 350, illustrated as an arm 350 (instead of partition 300), mounted on the threaded portion 123 of drive shaft 120 that travels along the threaded portion 123 when drive shaft 120 rotates. Sensors 153 are positioned at predetermined axial positions relative to drive shaft 120 and sensed member 156 (such as magnet 156) is connected to arm 350 and detectable by the plurality of sensors 153. In general, magnet 156 triggers sensor(s) 153 when arm 350 is positioned proximate a corresponding sensor 153 as arm 350 travels axially along the drive shaft 120 when drive shaft 120 rotates. In one example embodiment, movement of arm 350 and triggering of sensor(s) 153 at appropriate locations may be used to indicate that the paddle assembly is operating normally, in the same manner as discussed above with respect to FIG. 5. In this way, other toner cartridges compatible with imaging apparatus 22 may be used, such as a toner cartridge that includes a waste toner container with fixed volume, a toner cartridge including a bag that provides an expanding waste storage volume, or a toner cartridge that does not include a separate waste toner volume, among many others, by incorporating a thread follower whose axial movement and/or position can be detected by imaging apparatus 22.

Figure 8A:
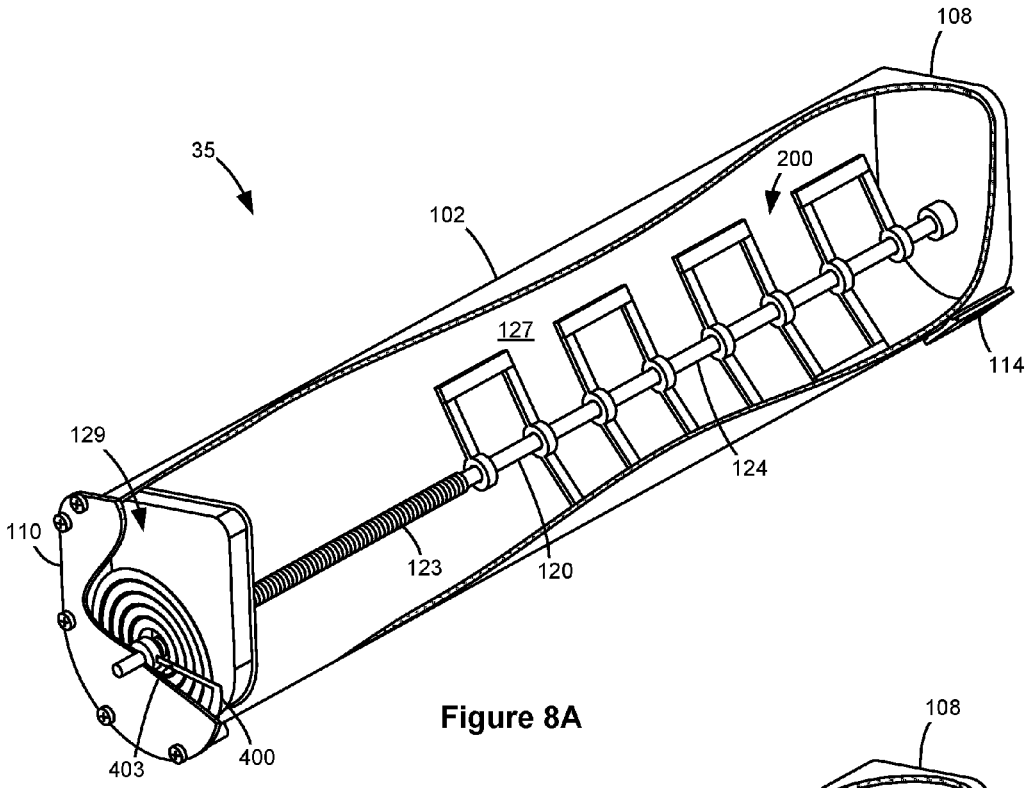
FIGS. 8A and 8B are perspective views of the toner cartridge illustrating interior components thereof including an expanding spiral agitator according to one example embodiment.
Figure 8B:
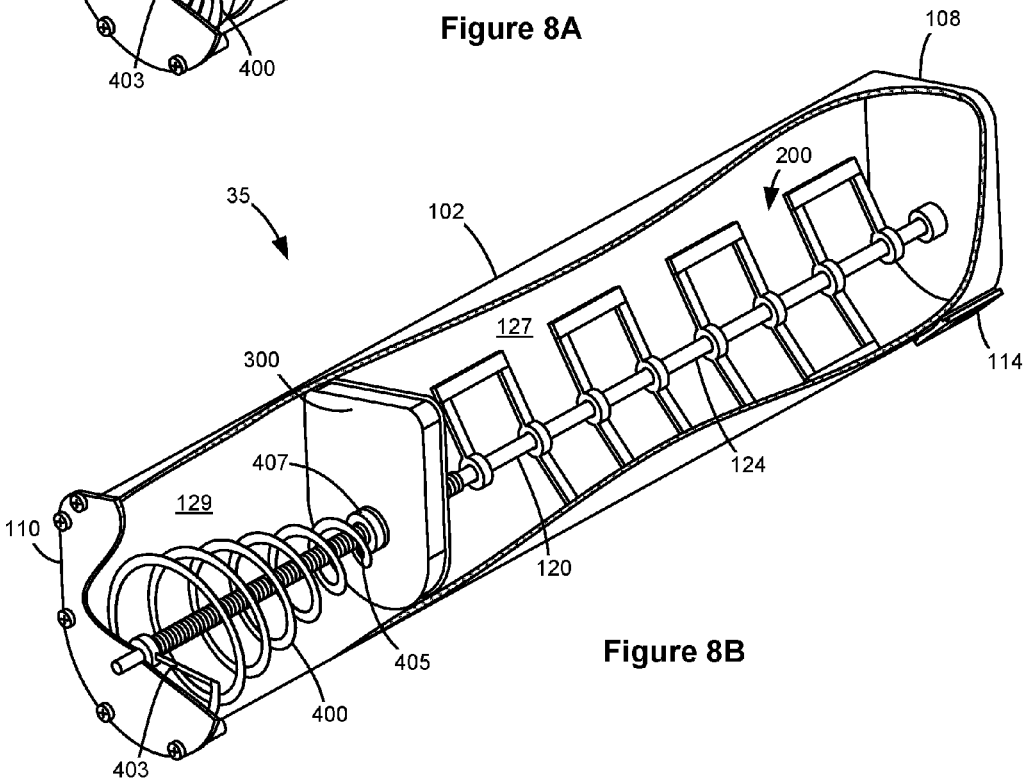
Figure 9A:
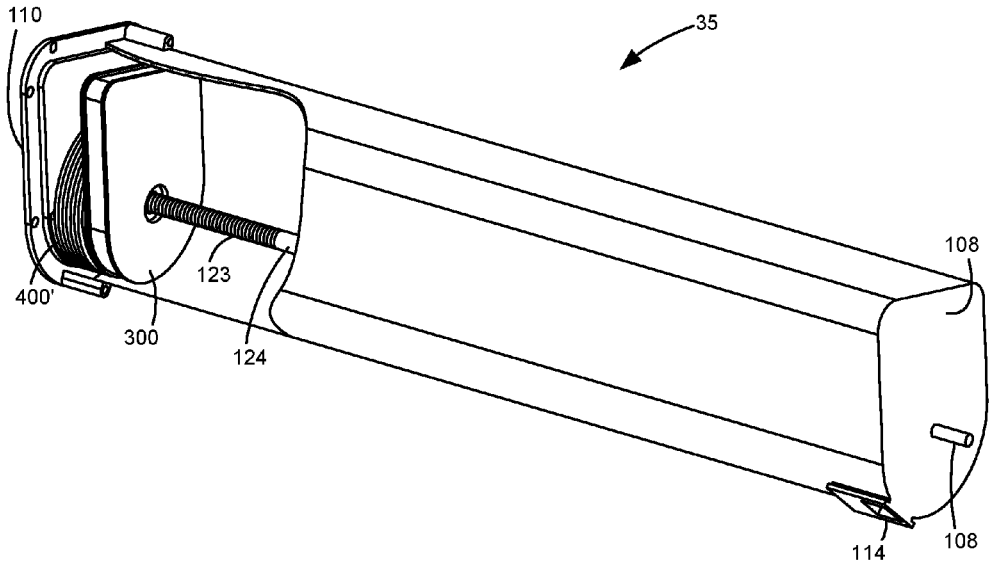
FIGS. 9A and 9B are perspective views of the toner cartridge illustrating interior components thereof including an expanding helical agitator according to one example embodiment.
Figure 9B:
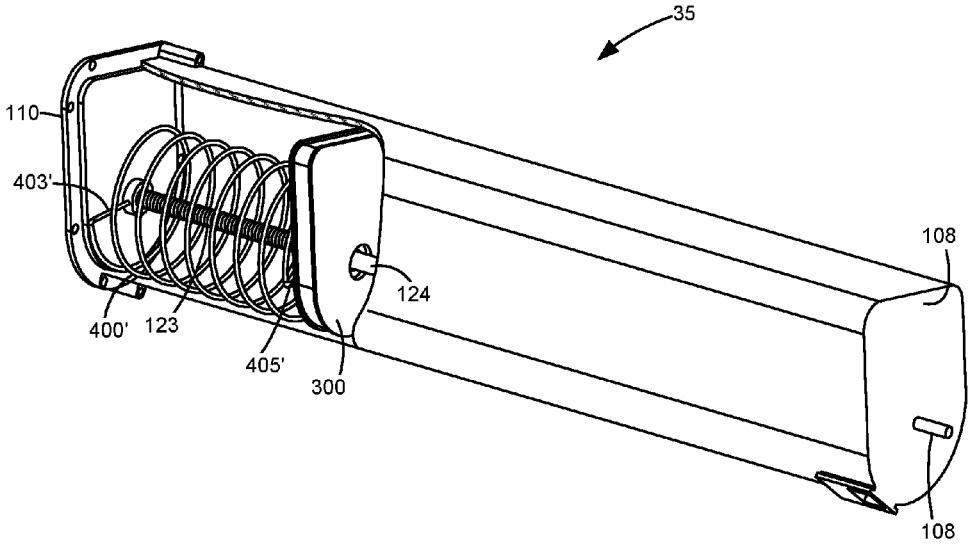

Referring now to FIGS. 8A-9B, second toner compartment 129 may include an expandable agitator 400 that is used to agitate and/or redistribute waste toner therein to prevent waste toner particles from bridging or clumping within second toner compartment 129, which could block the deposition of additional waste toner in second toner compartment 129. As shown, agitator 400 is movable between a collapsed state (FIGS. 8A and 9A) and an expanded state (FIGS. 8B and 9B). In general, agitator 400 is rotatable with drive shaft 120 and expands as the volume of second toner compartment 129 expands due to movement of partition 300 along drive shaft 120 toward junction 125.

FIGS. 8A and 8B show agitator 400 formed in a generally conical or spiral shape and having a first end 403 and a second end 405. In one example embodiment, the first end 403 of agitator 400 is fastened to drive shaft 120 while second end 405 is rotatably coupled to partition 300 via a rotary connection 407. Fastening or fixedly coupling the first end 403 allows agitator 400 to rotate with drive shaft 120 and coupling the second end 405 to partition 300 allows the second end 405 to move axially with partition 300 and expand agitator 400 as partition 300 moves axially to expand the second toner compartment 129. In one example, rotary connection 407 may include a ball bearing in the shape of a ring having an inner race fixedly attached to partition 300 and an outer race attached to the second end 405 of agitator 400, or vice versa. Alternatively, the second end 405 of agitator 400 may be coupled to drive shaft 120 so that agitator 400 is rotated and second end 405 is driven axially by the rotation of drive shaft 120. For example, the second end 405 may be captured in a keyway cut along drive shaft 120 or the second end 405 may have a D-shaped keyway that is received by a flat cut along a length of drive shaft 120. In this manner, agitator 400 is rotated by driving both its first and second ends 403, 405 to rotate with drive shaft 120. Alternatively, agitator 400 may be rotated by driving only the second end 405 to rotate with drive shaft 120, such as by coupling second end 405 to drive shaft 120 in a manner previously described. In this example, first end 403 may be rotatably coupled to end wall 110 via a rotary connection and rotatable about drive shaft 120.

The example embodiment shows spiral agitator 400 having a diameter that tapers inwardly from end wall 110 of body 102 to partition 300. It will also be appreciated that a reverse arrangement of spiral agitator 400 may be implemented wherein its diameter tapers outwardly from end wall 110 of body 102 to partition 300. In one embodiment, agitator 400 is made of wire. In another embodiment, agitator 400 is formed by cutting a spiral from a flat sheet of material. The spiral shape of agitator 400 allows it to be compressed to a substantially flat sheet when partition 300 is at an axial position shown in FIG. 8A. Agitator 400 is fully expanded when partition 300 is at its final position P3. In other alternative embodiments, agitator 400 may have curved and/or notched edges.

FIGS. 9A and 9B show toner cartridge 35 including agitator 400' formed in the shape of a helical spring. First and second ends 403', 405' of helical agitator 400' may be connected to drive shaft 120 and/or partition 300 in the same manner described above with respect to first and second ends 403, 405 of spiral agitator 400. When partition 300 is at an axial position shown in FIG. 9A, agitator 400' is in the collapsed or compressed state. When partition 300 is at its stop position P3 shown in FIG. 9B, agitator 400' is fully expanded.

In one embodiment, when drive shaft 120 rotates to rotate paddle assembly 200 during toner feeding, agitator 400 rotates with drive shaft 120, expanding as its second end 405 moves together with partition 300 while agitating and/or moving waste toner within second toner compartment 129 towards partition 300 in order to clear the portion of second toner compartment 129 under waste toner inlet port 116 to accommodate the receipt of additional waste toner.

In accordance with another example embodiment of the present disclosure, toner cartridge 35 may be configured such that at least some of the waste toner delivered by the waste toner transfer system 36 is reincorporated with fresh toner in the first toner compartment 127 for reuse. Waste toner is produced by incomplete transfer of a toner image from the photoconductive drum 80 or the intermediate transfer member. Typically, waste toner is contaminated with paper fibers or is of low charge due to extra particulate additives (EPAs) on the toner particle surface. However, shortly after a toner cartridge 35 is installed, waste toner is almost identical to fresh toner. This type of waste toner comes primarily from the photoconductive drum 80 and is produced during cycle-up of the imaging apparatus 22 if the developer bias is temporarily greater in magnitude than the photoconductor bias. Thus, an initial amount of waste toner may be suitable for recycling back into the first toner compartment 127 and then, after a certain time period, such as after a predetermined number of rotations of drive shaft 120 or after a predetermined amount of fresh toner has exited the first toner compartment 127, waste toner may be deposited into the second toner compartment 129.

Figure 10A:
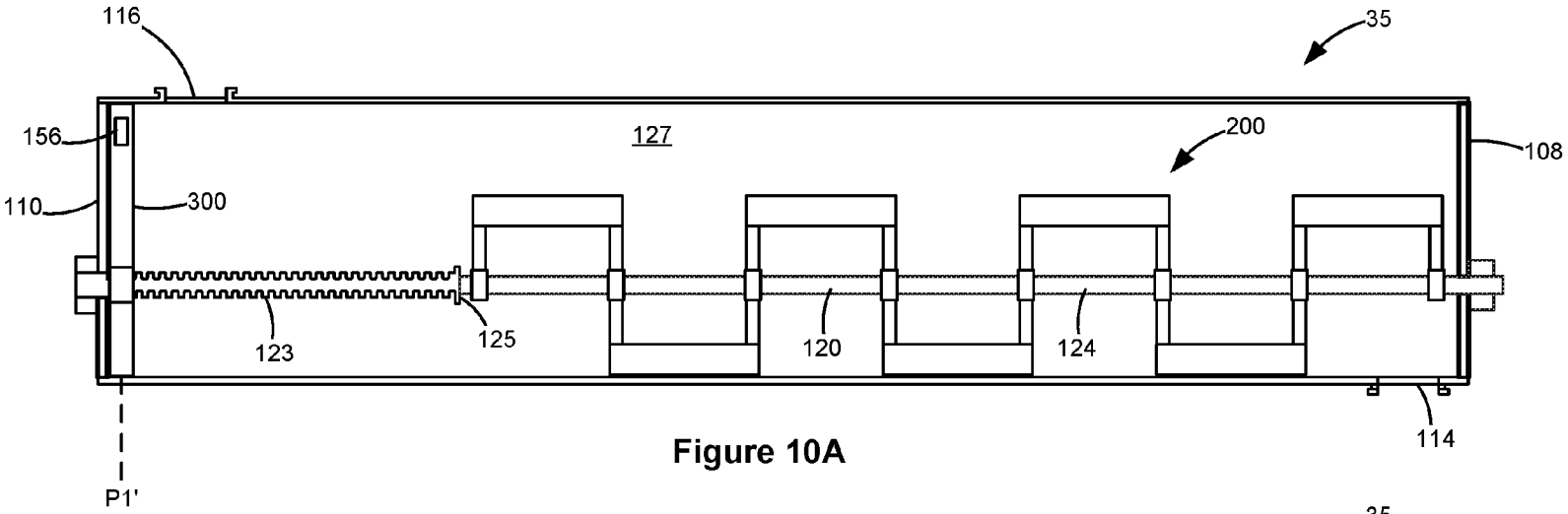
FIG. 10A illustrates the toner cartridge partition located at an initial position in which a waste toner inlet port is in fluid communication with the fresh toner compartment to incorporate initial waste toner with fresh toner according to one example embodiment.
Figure 10B:
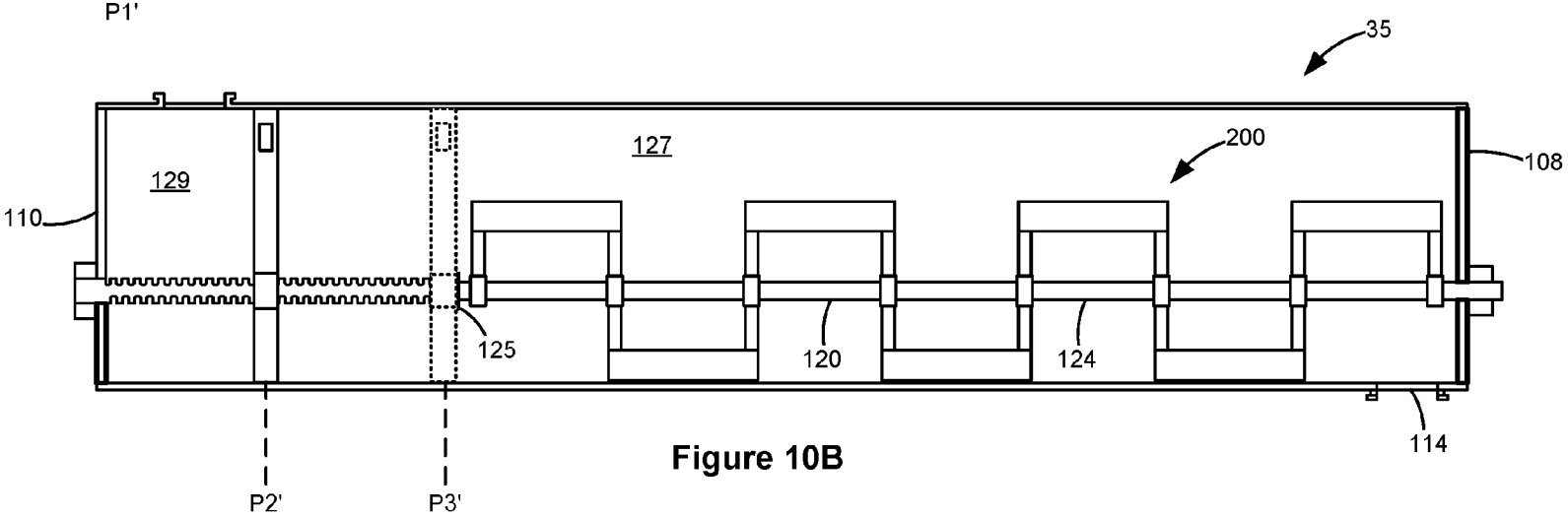
FIG. 10B illustrates the toner cartridge partition in FIG. 10A moved to axial positions in which the waste toner inlet port is in fluid communication with the waste toner compartment to deposit remaining waste toner therein according to one example embodiment.

In the example embodiment shown in FIG. 10A, partition 300 is initially positioned at an axial position between waste toner inlet port 116 and end wall 110 of body 102 such that waste toner inlet port 116 is initially in fluid communication with first toner compartment 127. Accordingly, an initial amount of waste toner delivered by the waste transport mechanism 95 is reincorporated with fresh toner (not shown) in the first toner compartment 127 at the outset of toner cartridge use. As drive shaft 120 rotates in its operative rotational direction, partition 300 moves from its initial position P1' to an intermediate position P2' past waste toner inlet port 116, relative to the direction of travel of partition 300 toward junction 125, as shown in FIG. 10B. In the intermediate position P2', waste toner inlet port 116 is in fluid communication with the second toner compartment 129 such that remaining waste toner is deposited within the second toner compartment 129. As with above example embodiments, sensors may be employed within imaging apparatus 22 at predetermined axial locations relative to drive shaft 120 to monitor the location of partition 300 as it moves along drive shaft 120 until partition 300 reaches its final position P3'.

Figure 11A:
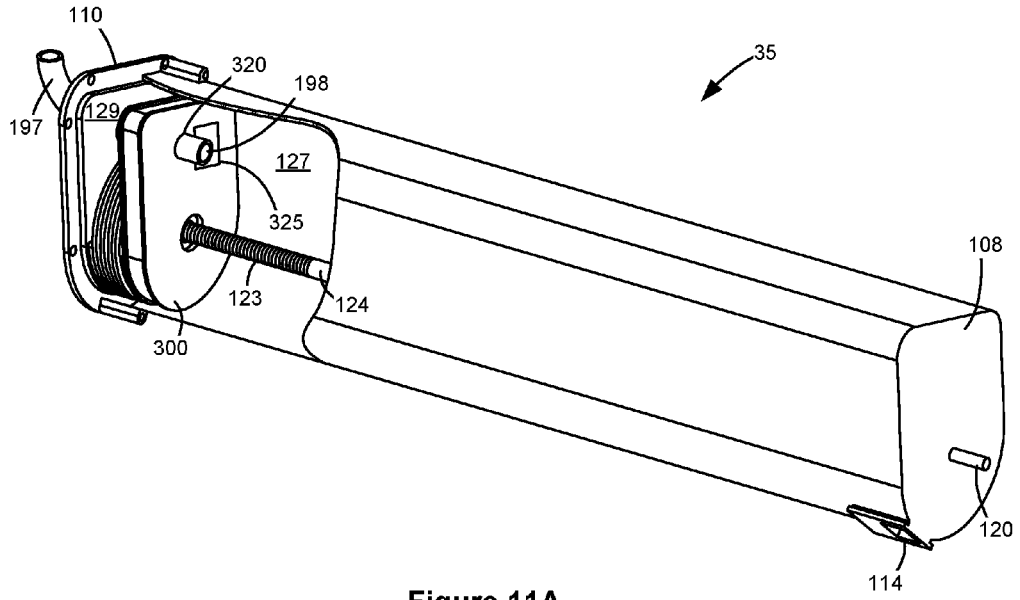
FIGS. 11A and 11B illustrate a configuration for reincorporating initial waste toner into the fresh toner compartment according to another example embodiment.
Figure 11B:
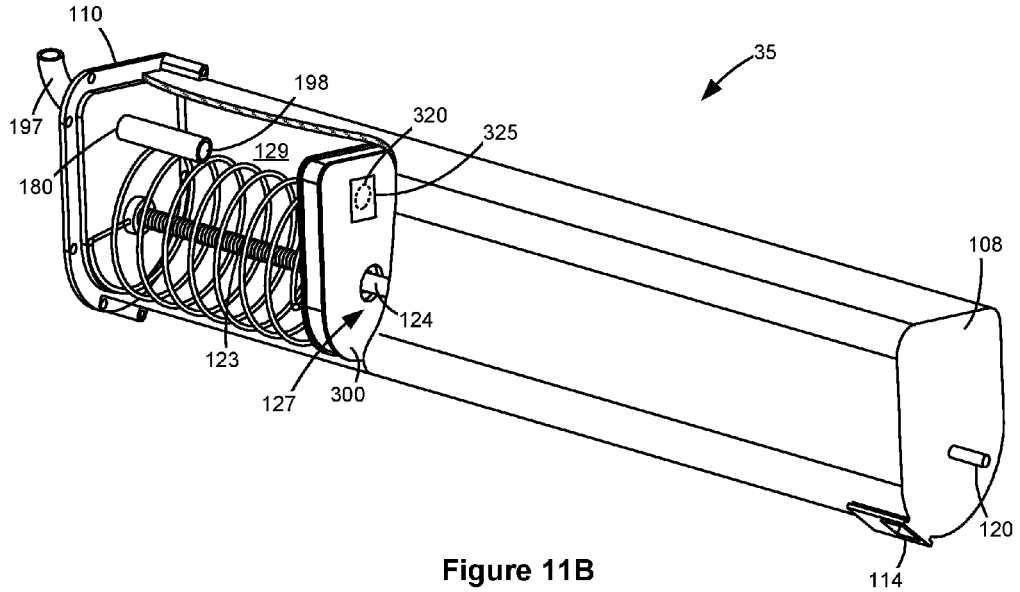

In another example embodiment illustrated in FIGS. 11A and 11B, a waste tube 197 passes through an opening 180 provided in end wall 110 of toner cartridge 35. Partition 300 is also provided with an opening 320 that is aligned with the opening 180 in end wall 110 and sized to receive waste tube 197. In order to reincorporate an initial amount of waste toner into the first toner compartment 127, partition 300 is initially positioned such that waste tube 197 passes through opening 320 and a waste toner exit end 198 of waste tube 197 extends into the first toner compartment 127 as shown in FIG. 11A. Partition 300 may include a shutter 325 that is movable with respect to waste tube 197 between an open position and a closed position. When waste tube 197 passes through opening 320 of partition 300 and waste toner exit end 198 extends into the first toner compartment 127, shutter 325 is in the open position and waste toner is deposited into the first toner compartment 127. During toner feeding, drive shaft 120 rotates in its operative rotational direction causing partition 300 to travel axially away from the end wall 110. When partition 300 moves past the waste tube exit end 198, shutter 325 moves to the closed position to cover opening 320 and prevent fresh toner in the first toner compartment 127 from entering the second toner compartment 129 and waste toner is deposited into the second toner compartment 129. In one example, shutter 325 is spring loaded closed and pushed open by waste tube 197.

The configurations for reincorporating waste toner with fresh toner are not limited to the example embodiments shown in FIGS. 10A-11B. Other configurations are possible. For example, partition 300 may include a valve (not shown) that, when open, allows waste toner in the second toner compartment 129 to flow through an open section at a bottom portion of partition 300 into the first toner compartment 127. Moving waste toner in the second toner compartment 129 towards partition 300, through the open section, and into the first toner compartment 127 to reincorporate waste toner with fresh toner in the first toner compartment 127 may be accomplished by providing an agitator, such as agitator 400', in the second toner compartment 129. After partition 300 moves to a predetermined axial position, the valve may be triggered, such as by a projection within toner cartridge 35 or by a magnet adjacent toner cartridge 35, to close off the open section and prevent waste toner in the second toner compartment 129 from entering the first toner compartment 127.

In another example, waste toner transfer system 36 may include a first waste tube (not shown) for transporting waste toner into the first toner compartment 127 and a second waste tube (not shown) for transporting waste toner into the second toner compartment 129. In this example, two separate waste toner entry points may be provided which are in fluid communication with the first toner compartment 127 and second toner compartment 129 and receive waste toner from the first and second waste tubes, respectively. The partition dividing the toner reservoir may be movable as described in the above example embodiments or fixed such that the first and second toner compartment volumes are fixed. A valve (not shown) may be provided to control the flow of waste toner to either the first toner compartment 127 or the second toner compartment 129. For example, the valve may be controllable to selectively switch the flow of waste toner between the first waste tube and second waste tube to deposit waste toner within the first toner compartment 127 or second toner compartment 129, respectively. In one example, the valve switches from the first waste tube to the second waste tube when partition 300 passes a predetermined axial position along drive shaft 120. In another example, the switch is triggered when the print count from toner cartridge 35 reaches a preset value.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge for an electrophotographic image forming device, comprising:

a housing having a reservoir for storing toner, the housing having an exit for exiting toner from the housing and an entry port for receiving waste toner into the housing; and a partition dividing the reservoir into a first compartment for storing fresh toner and a second compartment for storing waste toner, the first compartment is in fluid communication with the exit, the partition is movable within the reservoir between a first position and a second position, wherein the entry port is in fluid communication with the first compartment when the partition is in the first position such that waste toner received through the entry port is deposited into the first compartment when the partition is in the first position and the entry port is in fluid communication with the second compartment but closed off from the first compartment when the partition is in the second position such that waste toner received through the entry port is deposited into the second compartment but blocked from entering the first compartment when the partition is in the second position.

2. The toner cartridge of claim 1, further comprising a rotatable shaft positioned within the reservoir, wherein the partition is moveable by rotation of the shaft.

3. The toner cartridge of claim 2, wherein the partition is mounted on the shaft and moveable axially along the shaft.

4. The toner cartridge of claim 1, further comprising a paddle assembly positioned within the first compartment for mixing waste toner with fresh toner within the first compartment.

5. A system for recycling waste toner in an electrophotographic image forming device, comprising:

a toner cartridge including a housing having a reservoir for storing toner and a partition within the reservoir dividing the reservoir into a first compartment for storing fresh toner and a second compartment for storing waste toner, the housing having an exit in fluid communication with the first compartment for exiting toner from the toner cartridge and at least one waste toner entry point for introducing waste toner into the toner cartridge; and a waste toner transfer system positioned to move waste toner in the electrophotographic image forming device to the at least one waste toner entry point of the toner cartridge, wherein the waste toner transfer system is configured to deliver an initial amount of waste toner from the electrophotographic image forming device into the first compartment of the toner cartridge for mixing with the fresh toner and a remaining amount of waste toner from the electrophotographic image forming device into the second compartment of the toner cartridge separated from the first compartment.

6. The system of claim 5, wherein the waste toner transfer system delivers the remaining amount of waste toner into the second compartment after an amount of fresh toner has exited the first toner compartment.

7. The system of claim 5, wherein the partition is movable within the reservoir between a first position in which the at least one waste toner entry point is in fluid communication with the first compartment and the initial amount of waste toner is introduced therein and a second position in which the at least one waste toner entry point is in fluid communication with the second toner compartment and the remaining amount of waste toner is introduced therein.

8. The system of claim 7, wherein the toner cartridge includes a rotatable shaft positioned within the reservoir and the partition is moveable by rotation of the shaft.

9. The system of claim 5, wherein the at least one waste toner entry point includes an opening formed through an end wall of the toner cartridge and the waste toner transfer system includes a waste tube extending through the opening, wherein the waste tube extends through the partition and into the first compartment via a hole in the partition when the partition is in a first position such that waste toner exiting the waste tube is deposited into the first compartment and the waste tube extends within the second compartment when the partition is in the second position such that waste toner exiting the waste tube is deposited within the second toner compartment.

10. The system of claim 9, further comprising a shutter moveable between a closed position blocking the opening and an open position unblocking the opening.

11. The system of claim 10, wherein the shutter moves from the open position to the closed position when the partition moves to a predetermined position within the reservoir.

12. A method for recycling waste toner into a toner cartridge of an electrophotographic image forming device, comprising:

partitioning a reservoir of the toner cartridge into a first compartment for storing fresh toner and a second compartment for storing waste toner;

moving an initial amount of waste toner in the electrophotographic image forming device into the first compartment of the toner cartridge reservoir for mixing with the fresh toner; and after moving the initial amount of waste toner into the first compartment, moving a remaining amount of waste toner in the electrophotographic image forming device into the second compartment of the toner cartridge reservoir separated from the fresh toner in the first compartment.

13. The method of claim 12, wherein the moving the initial amount of waste toner into the first compartment includes moving the partition to a position in which a waste toner entry point of the toner cartridge is in fluid communication with the first compartment.

14. The method of claim 12, wherein the moving the remaining amount of waste toner into the second compartment includes moving the partition to a position in which a waste toner entry point of the toner cartridge is in fluid communication with the second compartment.

15. The method of claim 12, wherein the moving the remaining amount of waste toner into the second compartment is performed after an amount of fresh toner is removed from the toner cartridge.

* * * * *